US005370252A

United States Patent [19]

Parsons et al.

[11] Patent Number: 5,370,252

[45] Date of Patent: Dec. 6, 1994

[54] CAP

[75] Inventors: Joseph R. B. Parsons; Joanna M. Parsons, both of Ferntree Gully, Australia

[73] Assignee: Joseph Parsons Nominees Pty. Ltd., Victoria, Australia

[21] Appl. No.: 700,127

[22] PCT Filed: Nov. 27, 1989

[86] PCT No.: PCT/AU89/00513

§ 371 Date: May 30, 1991

§ 102(e) Date: May 30, 1991

[87] PCT Pub. No.: WO90/06267

PCT Pub. Date: Jun. 14, 1990

[30] Foreign Application Priority Data

Nov. 28, 1988 [AU] Australia ..... PJ1678

[51] Int. Cl.[5] ..... B65D 39/00

[52] U.S. Cl. ..... 215/247; 215/355; 215/364

[58] Field of Search ..... 215/247, 296, 355, 364; 128/764; 604/415, 256, 244, 167, 88

[56] References Cited

U.S. PATENT DOCUMENTS

| | | | |
|---|---|---|---|
| 3,017,050 | 1/1962 | Barr, Sr. et al. | 215/247 |
| 3,092,278 | 6/1963 | Jarnhall | 215/247 |
| 4,187,893 | 2/1980 | Bujan | 215/247 X |
| 4,226,333 | 10/1980 | Percarpio | 215/247 |
| 4,254,884 | 3/1981 | Maruyama | 215/232 |
| 4,301,936 | 11/1981 | Percarpio | 215/247 |
| 4,441,621 | 4/1984 | Matukura et al. | 215/247 |
| 4,545,497 | 10/1985 | Martha, Jr. | 215/253 |
| 4,635,807 | 1/1987 | Knapp | 215/247 |
| 4,664,274 | 5/1987 | Konrad | 215/232 |
| 4,715,360 | 12/1987 | Akui et al. | 604/256 X |
| 4,809,679 | 3/1989 | Shimonaka et al. | 604/167 X |
| 4,886,177 | 12/1989 | Foster | 215/247 |
| 4,892,222 | 1/1990 | Schmidt et al. | 215/247 X |
| 4,920,976 | 5/1990 | Calzi et al. | 215/247 X |

FOREIGN PATENT DOCUMENTS

| | | |
|---|---|---|
| 104862 | 9/1938 | Australia . |
| 138155 | 7/1950 | Australia . |
| 2477677 | 11/1978 | Australia . |
| 506028 | 12/1979 | Australia . |
| 517738 | 8/1981 | Australia . |
| 547866 | 11/1985 | Australia . |
| 9169482 | 7/1986 | Australia . |
| 586772 | 1/1988 | Australia . |
| 586390 | 9/1988 | Australia . |

*Primary Examiner*—Allan N. Shoap
*Assistant Examiner*—Vanessa Caretto
*Attorney, Agent, or Firm*—Evenson, McKeown, Edwards & Lenahan

[57] ABSTRACT

A cap (1) adapted for co-operation with a container (2) to provide a resealable enclosed space, said cap comprising an upper portion (3) including an elongate member (12) and a lower portion (4) having a barrier (5) or flap disposed on the lower portion to substantially prevent container contents contacting the elongate member when the cap is in a closed position, and to substantially reduce leakage of container contents when the cap is in an open or access position. An air space or cushion (6) may also be provided between the upper portion (3) and the barrier (5). A ring (8) may further be provided to seal between the upper and lower portions of the cap.

9 Claims, 3 Drawing Sheets

CAP

FIELD OF INVENTION

The present invention relates to an improvement, modification or advance over the invention disclosed in PCT Application No. PCT/AU88/00353 filed Sep. 9, 1988, entitled "CAP".

The present invention relates to a cap or closure member for a container and relates particularly but not exclusively to a cap or closure member capable of sealing the container in a substantially pressure tight manner to allow a predetermined reduced pressure to be applied to the cap and container combination to enable a fluid or fluidized sample to be drawn into the container by way of the reduced pressure. The present invention also relates to a cap or closure member which enables access to the fluid sample so collected without the necessity of removing the cap from the container. The present invention also relates to a cap or closure member which enables access to the interior of the container by disassembling only a portion of the cap.

In particular, the present invention relates to such a cap having a membrane or barrier means which serves as a barrier and substantially reduces contamination and leakage of container contents when the cap is partially disassembled.

DEFINITION

Throughout this specification, the term "barrier" includes flap, valve, split or perforated membrane or buffer means which serves to reduce the passage of container contents or fluid therethrough.

PCT/AU88/00353 discloses a two part cap for a container, the cap enabling piercing access to the interior of the container for fluid sampling or evacuation thereof and non-piercing access by means of removing the top part of the cap structure to allow substantially unimpeded access to the interior of the container.

The top part of the cap comprises a substantially T-shaped portion, the bottom of which may come into contact with any fluid in the container when the cap is in a closed position.

OBJECT(S) OF INVENTION

An object of the present invention is to alleviate some or all of the disadvantages of the prior art by providing a cap in which a barrier portion forms at least a partial barrier to leakage of container contents.

A further object of the present invention is to provide a cap in which an air cushion is formed in conjunction with the barrier means to further alleviate contamination and contents leakage.

DESCRIPTION OF INVENTION

The present invention may (in one preferred form) provide a cap adapted for co-operation with a container having an upper portion and a lower portion adapted to form a resealable enclosed space, said cap having barrier means disposed to reduce leakage of container contents.

The present invention may also provide a cap for attachment to a container, the cap forming a resealable enclosed space and having upper and lower portions, wherein, in a sealed position, an air cushion is provided adjacent the base of the lower portion, the cushion serving as a buffer to reduce contact of container contents with the upper portion.

The present invention also may (in another preferred form) provide a cap adapted for co-operation with a container to provide a resealable enclosed space capable of evacuation to a predetermined level of reduced pressure, said cap having two parts;

the first part comprising an upper portion including a pierceable cover portion having an integrally formed sealing member dependent therefrom; and the second part comprising a lower portion including an access port for access to said enclosed space, the first and second parts being adapted to co-operate together to form a re-useable seal, the cap being adapted for piercing or non-piercing communication with said enclosed space; including the improvement comprising:

barrier means disposed on said second part and adapted to substantially reduce container contents leakage from said enclosed space or contamination of said first part by said contents.

The barrier means may be in the form of a split or perforated membrane, flap(s), buffer or valve like structure.

The present invention may also provide a cap adapted for co-operation with a container to provide a resealable enclosed space, said cap comprising an upper portion including an elongate member, and a lower portion having a barrier disposed on the lower portion to substantially prevent container contents contacting the elongate member when the cap is in a closed position.

The air cushion is defined in one form as bounded by the walls of the cap upper and lower portions and the barrier.

The present invention may further provide a cap for co-operation with a container, comprising an upper portion and a lower portion, the upper portion being detachable from the lower portion and allowing access to the interior of the container in such a detached position, wherein a seal member or ring is provided on the upper portion which engages a corresponding recess on the lower portion, the seal and recess forming a reuseable seal between the upper and lower portions.

Throughout this specification, the term "tube" or "container" is to be construed in a broad sense. A most preferred and specific application of the present invention relates to test tubes, laboratory analyser containers, jars or specimen containers, although not exclusively so.

The cap of the present invention may be made of one or more suitable materials of any type. Preferably, the cap material allows the cap to provide the function of being sealable and adapted to be pierceable. The material may also be elastically deformable. The material may be silicon rubber, soft rubber, neoprene, other suitable pierceable material(s), or a combination thereof.

Preferred embodiments of the present invention will now be described with reference to the accompanying drawings, wherein.

It is to be noted that throughout the Figures, means or features of the same or similar type are indicated by the same reference numeral. Also, the gaps shown between upper and lower portions of the cap are only for the purpose of illustration of the components outline.

Figure 4A:
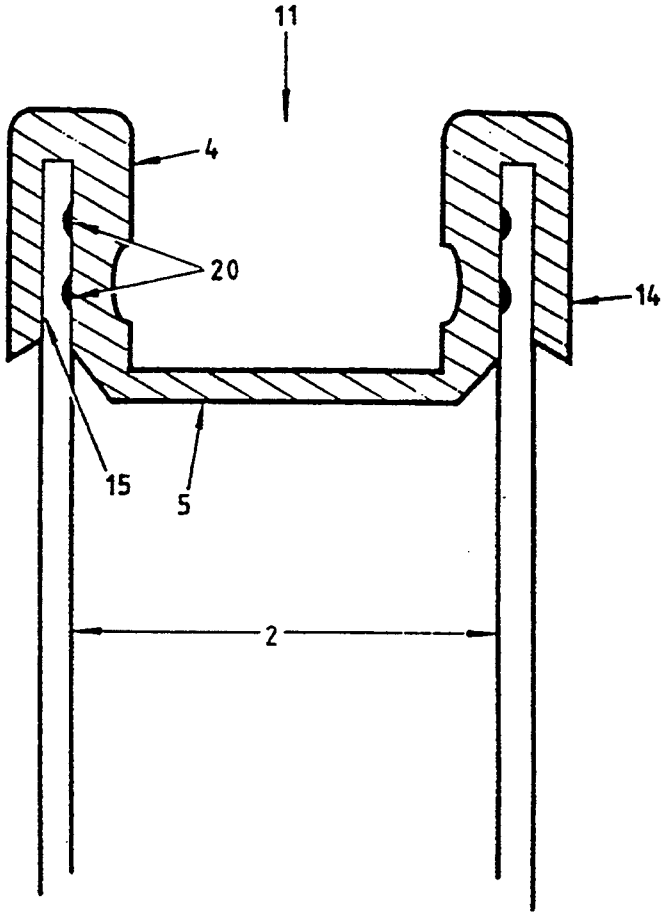

FIGS. 1, 2, 4A and 4B show a cap 1 having an upper portion 3 and a lower portion 4. The cap 1 is shown attached or held in place in relation to a tube or container 2 by means of a recess or rim 13 in the case of FIG. 2 or bulges 20 of FIG. 4A provided in the lower portion 4 of the cap which co-operates with the top of the tube 2. Lip 14 provides a seal about the tube 2 in addition to the inner surface 15 of recess 13.

The cap may alternatively have the lower portion 4 formed as an "all in" push type wherein a shoulder 16 is only provided to prevent the cap from being immersed too far into the tube 2.

The lower portion 4 generally provides an access to tube interior or contents via access 11. The access 11 may be of any suitable size within the limits of the container's size and its designated application. The upper portion 3 of the cap 1 is generally T-shaped, wherein the elongate member 12 fits into or co-operates with the access in a substantially sealing manner. The upper portion 3 is provided with a ring or seal 8 around the elongate member which mates with a corresponding depression in the lower portion 4 to provide additional sealing to the cap in its closed position. Furthermore, the ring substantially prevents the upper and lower portions from separating without operator intervention.

The access 11 of the lower portion may be of any suitable size as noted above and may be almost as large as the tube opening into which the lower portion 4 fits. This allows for easy access to the tube contents by a probe of a laboratory analyser if the lower portion is fitted to a suitable analyser sample cup.

A recess 7 can be provided in the upper portion to facilitate piercing access to the interior of the tube and its contents generally through the elongate member 12. The recess 7 may be quite large in relation to the upper portion, thereby leaving only a narrow wall to be pierced during piercing access to the sealed container.

Figure 3A:
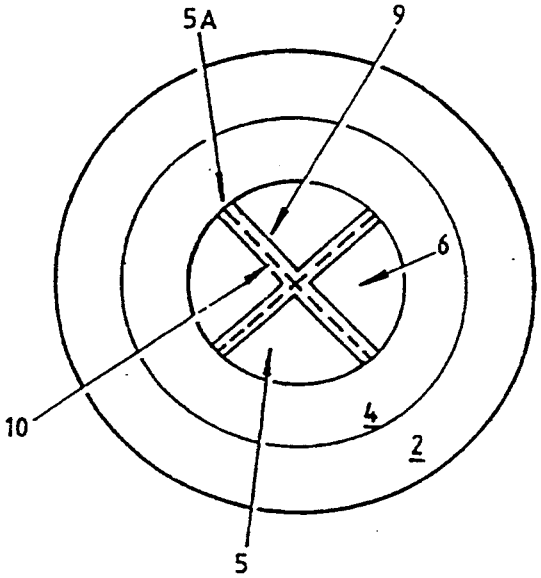
FIGS. 3A and 3B show alternative views of the underneath of the upper portion of the cap.
Figure 4B:
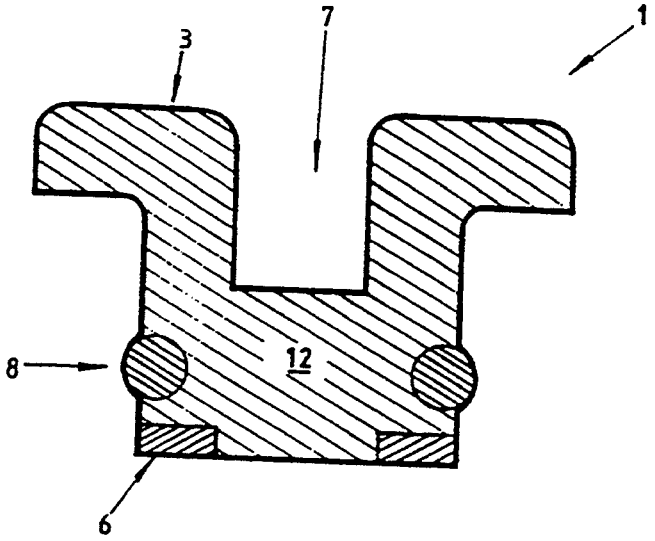
FIGS. 4A and 4B show alternative arrangements of the lower and upper portions of the cap, respectively.

The lower portion 4 is provided with a barrier means or flaps 5 which form a barrier or buffer between the interior of the tube or its contents and the upper portion 3 and/or the outside world. In the case where a tube and cap combination has the upper portion 3 removed, the access position, and the tube is, for example, accidently knocked over, the barrier 5 is designed to substantially prevent the tube contents from escaping. The barrier need not be continuous, it may be perforated, slotted or have a small hole therein as shown in FIG. 3A to allow passage of a non-piercing probe into the tube, and thereafter when the probe is withdrawn, substantially forming a leak resistant barrier again. This alleviates contamination. Also an air space or cushion 6 is also provided between the barrier 5 and the upper portion 3 when the cap is in a closed or fitted position. With the upper portion in a fitted or closed position, the air space 6 provides a cushion of air which substantially prevents the barrier 5 from opening and releasing tube contents if the tube is knocked over and thereby contaminating the upper portion 3. Also, in an open position (without the upper portion 3 in place), barrier 5 also reduces the amount of tube contents released if the tube is knocked over. In fact, barrier 5 also aids in laboratory analysis by reducing specimen evaporation while the specimen is awaiting testing. This evaporation is a major source of diagnostic error. The barrier is formed so as to allow an analyser probe or pipette or needle to pass therethrough so that a sample can be obtained from the tube contents. Upon retraction of the probe or pipette, the barrier resiliently moves back in place to again substantially prevent leakage of tube contents. The barrier may additionally act to wipe the probe, pipette or needle as it is withdrawn from the container, which will further reduce contamination. FIG. 3A shows a preferred barrier 5 having a quadrant shape, however, it is understood that many other shapes are equally useful.

Figure 1:
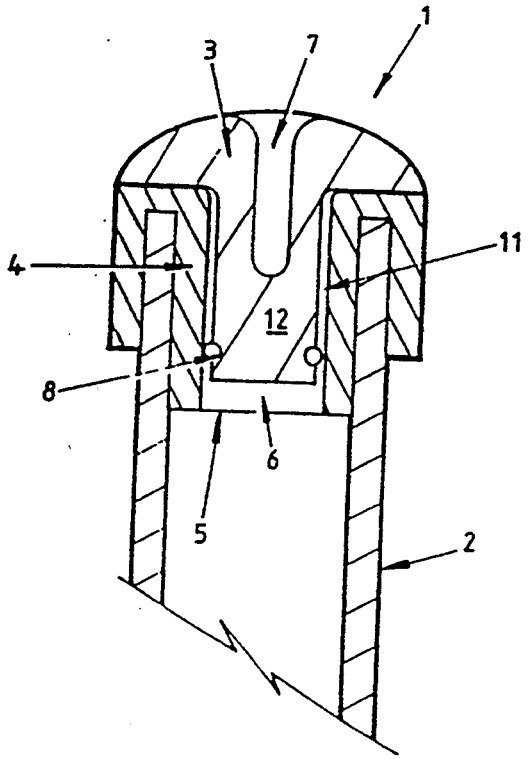
FIG. 1 shows a first embodiment of the present invention.
Figure 2:
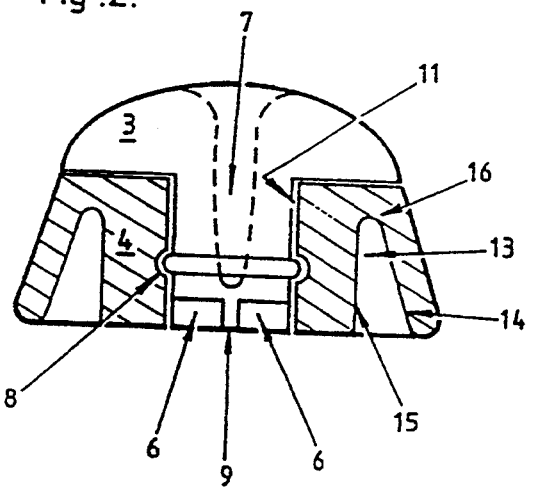
FIG. 2 shows a second embodiment of the present invention.
Figure 3B:
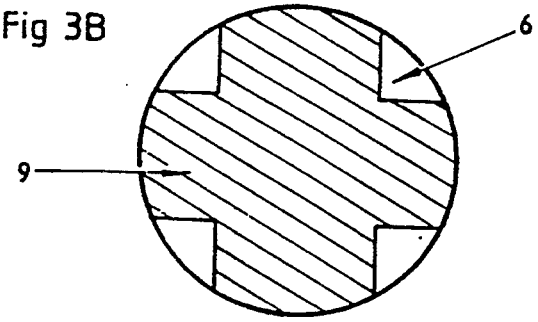

As shown in FIGS. 2, 3A and 3B, feet 9 may be provided on the bottom of upper portion 3. The feet 9 may assist in holding the flaps in a closed position. The air cushion 6 may be formed between the feet 9. Furthermore, as shown in FIGS. 2, 3A and 3B, between each foot, a pocket of air 6 is held. In this way, the provision of feet provides a number of smaller air cushions 6 to assist barrier 5 retaining the container contents.

As shown in FIG. 3A, feet 9 may be oriented to sit over the joins or edges of flaps 5. However, the feet may be offset from the slots 10 which define parts of the barrier 5 and still provides an effective support to the barrier, the air cushion(s) then also helping to prevent the barrier from opening when the cap is in a closed position, in order to assist in the operation of the barrier.

There may be provided any number of barrier parts and they may also be arranged in a layered fashion to further accentuate the effect of the present invention.

The claims defining the invention are as follows:

1. A cap adapted for co-operation with a container to provide a resealable enclosed space capable of evacuation to a predetermined reduced pressure, said container being adapted for the handling of body fluid samples, said cap consisting of two parts, being an upper portion and a lower portion which, in a closed position are together adapted to form a reusable gas-proof seal for sealing an open end of said container, said seal formed in said closed position being broken in an open position, said upper portion forming a sealing plug for fitment with said lower portion, said upper portion being cannula-pierceable and self-resealing, said lower portion being adapted for fitment to said container, in a sealing manner, and being adapted to accommodate at least the plug of said upper portion to form said reusable seal between said upper and lower portions when said cap is in said closed position, said lower portion having an access port for providing either piercing or non-piercing access to said enclosed space when said cap is in said open position, said lower portion further having an integral barrier means disposed across said access port to substantially prevent container contents contacting the upper portion when the cap is in the closed position, said barrier means being penetratable to allow said access therethrough when the cap is in said open position and adapted to reform to prevent escape of liquid past the barrier.

2. A cap as claimed in claim 1, wherein the barrier means is slotted to form flaps.

3. A cap as claimed in claim 1, wherein the barrier means is a pierceable continuous membrane disposed across said access port.

4. A cap as claimed in claim 1, wherein an air cushion is provided between the upper portion and the barrier means.

5. A cap as claimed in claim 1, further comprising feet disposed on the upper portion.

6. A cap as claimed in claim 5, wherein in a sealed position, said feet serve to abut the barrier.

7. A cap as claimed in claim 1, wherein the upper portion is 'T' shaped with a recess at the top of the 'T' providing a lead-in for cannula access.

8. A cap adapted for a co-operation with a container to provide a resealable enclosed space capable of evacuation to a predetermined level of reduced pressure, said cap having a first part and a second part;

the first part comprising an upper portion with an integrally formed sealing member dependent therefrom, the upper portion including a recess that acts as a lead-in to allow cannula pierceability through both the upper portion and the first part, material of the upper portion causing self-resealing after being pierced;

the second part comprising a lower portion adapted to remain in situ on said container, said lower portion including an access port for access to said enclosed space when the cap is in an open position with the first part removed, the first and second parts being adapted so that the first part sealingly locates within the access port to form a reusable seal when the cap is in a closed position; and integral barrier means disposed on said second part and adapted to substantially reduce container contents leakage from said enclosed space or contamination of said first part by said contents, said barrier means being adapted to allow non-piercing access therethrough, but adapted to reform to prevent leakage from said enclosed space.

9. A cap as claimed in claim 8, further comprising an air cushion between said barrier means and said first part when the cap is in the closed position.

* * * * *